US007736090B2

(12) United States Patent
Janesky

(10) Patent No.: US 7,736,090 B2
(45) Date of Patent: Jun. 15, 2010

(54) DOWNSPOUT DRAIN OUTLET

(76) Inventor: Lawrence M. Janesky, 60 Silvermine Rd., Seymour, CT (US) 06483

( * ) Notice: Subject to any disclaimer, the term of this patent is extended or adjusted under 35 U.S.C. 154(b) by 319 days.

(21) Appl. No.: 11/608,090

(22) Filed: Dec. 7, 2006

(65) Prior Publication Data

US 2008/0138156 A1 Jun. 12, 2008

(51) Int. Cl.
*E02B 1/00* (2006.01)

(52) U.S. Cl. ..... 405/42; 405/43

(58) Field of Classification Search ..... 405/40, 405/42, 43

See application file for complete search history.

(56) References Cited

U.S. PATENT DOCUMENTS 3,587,239 A * 6/1971 Feland ..... 405/125

5,735,304 A * 4/1998 Chumley ..... 137/15.01

* cited by examiner

*Primary Examiner*—John Kreck
(74) *Attorney, Agent, or Firm*—Perman & Green, LLP

(57) ABSTRACT

A drain system for draining water to a ground surface includes an extension pipe and a drain outlet. The extension pipe is capable of being disposed underground below a grade of the ground surface. The drain outlet is communicably coupled to the pipe. The drain outlet has a base and a cover section. The base has a drainage surface, a drainage end and an inlet section. The drainage end forms at least one effluent drainage hole therein. The inlet section is adapted to be coupled to an outlet of the extension pipe. The drainage surface is disposed for guiding effluent from the inlet section to the drainage end. The cover section is coupled to and covers the base. The base is configured for founding the drain outlet to the ground, when the drain outlet is coupled to the pipe disposed underground. The at least one drainage hole is located substantially at or above the grade allowing substantially unimpeded affluent discharge from the inlet section through the at least one drainage hole to the ground surface.

20 Claims, 7 Drawing Sheets

DOWNSPOUT DRAIN OUTLET

BACKGROUND

1. Field

The exemplary embodiments disclosed herein relate to a drain outlet and, more particularly, to a drain outlet for downspout or sump pump discharge.

2. Brief Description of Related Developments

Buildings, such as homes, may have gutters that transport water from the roof and through a downspout dumping the roof water next to the building foundation. This water may accumulate and contribute to wet basement problems or erosion. One approach to solving the problems associated with water accumulation close to the foundation is to provide an above ground extension to the downspout in order to direct the water away from the building. This approach has problems whereby the extensions are not pleasing to the eye and must be either mowed around or moved to effectively mow the lawn. Another approach to solving the problems associated with water accumulation close to the foundation is to provide an underground extension to the downspout in order to direct the water away from the building. One example of such a system is disclosed in U.S. Pat. No. 4,161,186, hereby incorporated by reference in its entirety. Such a system directs water through an underground downspout extension and through a cylinder to the ground surface. This approach has problems whereby water may accumulate in the cylinder and may freeze causing damage to the system from expansion and clogging of the system. A further problem arises whereby the system is difficult to clean. Accordingly, there is a desire to provide a drainage system that provides effective drainage away from a foundation where the system is freeze resistant and easily cleaned of debris.

SUMMARY OF THE EXEMPLARY EMBODIMENTS

In accordance with an exemplary embodiment a drain system is provided for draining water to a ground surface. The system comprises an extension pipe and a drain outlet. The extension pipe is capable of being disposed underground below a grade of the ground surface. The drain outlet is communicably coupled to the pipe. The drain outlet comprises a base and a cover section. The base has a drainage surface, a drainage end and an inlet section. The drainage end forms at least one effluent drainage hole therein. The inlet section is adapted to be coupled to an outlet of the extension pipe. The drainage surface is disposed for guiding effluent from the inlet section to the drainage end. The cover section is coupled to and covers the base. The base is configured for founding the drain outlet to the ground, when the drain outlet is coupled to the pipe disposed underground. The at least one drainage hole is located substantially at or above the grade allowing substantially unimpeded affluent discharge from the inlet section through the at least one drainage hole to the ground surface.

In accordance with another exemplary embodiment a low profile surface drain outlet for draining affluent from a subterranean pipe to a grade is provided. The outlet comprises a base and a cover coupled to the base. The base has a substantially flat bottom. The base has a pipe inlet capable of being coupled to the pipe. The pipe inlet directs the affluent onto the substantially flat bottom. The cover is inclined relative to the bottom of the base and has a surface drain hole for the affluent to pass therethrough onto the grade. The cover has an edge disposed adjacent to the substantially flat bottom and forming a discharge edge of the drain outlet having at least one of the surface drain holes.

In accordance with another exemplary embodiment, a drain outlet adapted to drain water to a grade surface, the drain outlet coupled to a pipe, the pipe being underground and below the grade surface is provided. The drain outlet comprises a base having a drainage surface and a cover section removably coupled to the base and inclined relative to the drainage surface of the base. The base has an inlet coupled to the drain pipe with the drainage surface located below the pipe. The drainage surface is adapted to direct the water away from the drain pipe and through the cover section to the grade surface. The drainage surface is adapted to be positioned substantially below the grade surface. The drainage surface is adapted to be positioned to substantially intersect the grade surface. The cover section is adapted to be positioned substantially uniform with the grade surface. The drainage surface is adapted to drain substantially all of the water from the pipe to the grade surface without leaving any residual water in the base.

BRIEF DESCRIPTION OF THE DRAWINGS

The foregoing aspects and other features of the exemplary embodiments are explained in the following description, taken in connection with the accompanying drawings, wherein.

DETAILED DESCRIPTION OF THE EXEMPLARY EMBODIMENT(S)

Figure 1:
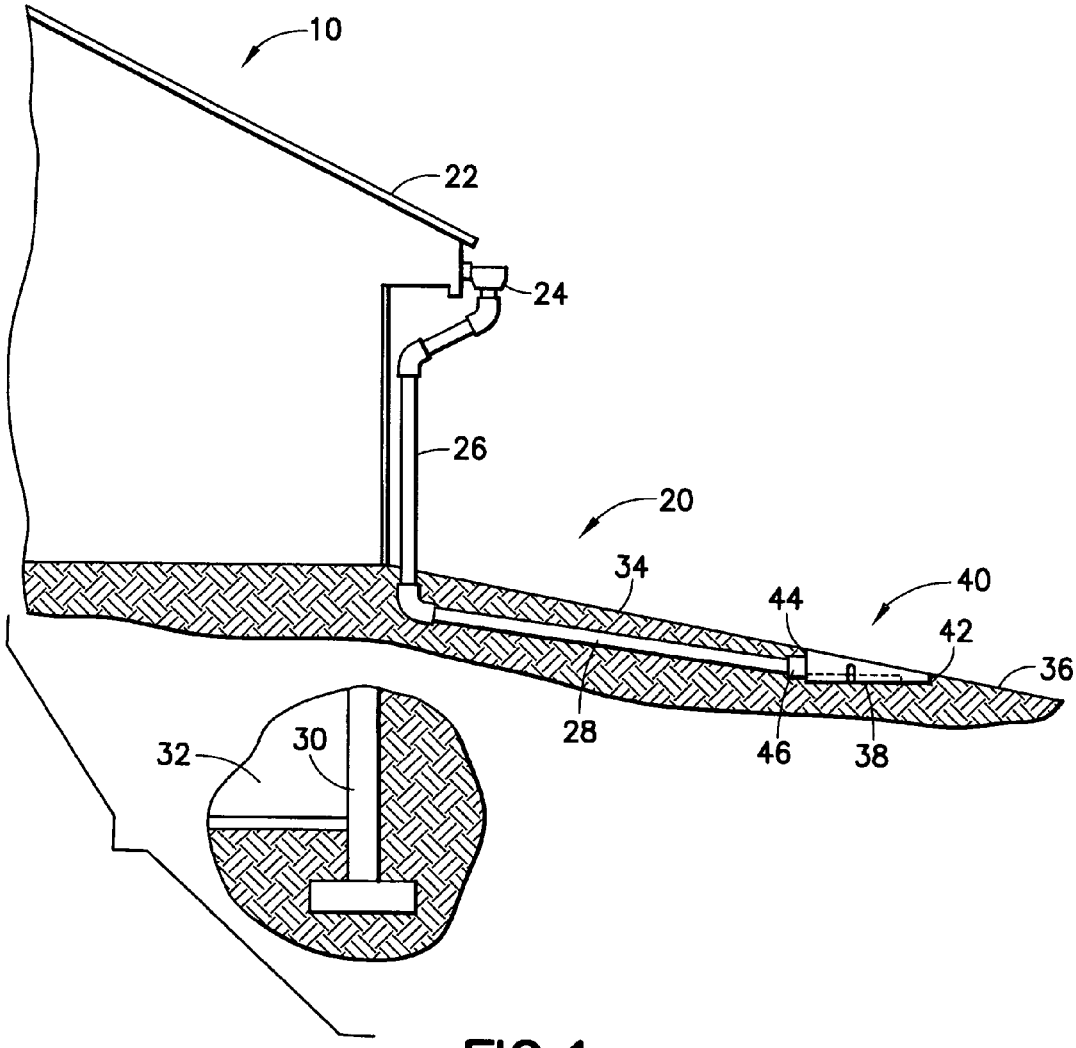
FIG. 1 is a side elevation view of a building shown partially in cross-section with a schematic side view of a drainage system.

Referring to FIG. 1, there is shown, side elevation view of a building shown partially in cross-section with a schematic side view of a drainage system incorporating features in accordance with an exemplary embodiment. Although the embodiments will be described with reference to the embodiments shown in the drawings, it should be understood that the present invention can be embodied in many alternate forms of embodiments. In addition, any suitable size, shape or type of elements or materials could be used.

Referring now to FIG. 1, a building 10, such as a house, is illustrated supported upon a peripheral foundation 30, for example, buried in the ground beneath the frost line. Drainage system 20 is provided to drain water from roof 22 and disperse the water away from building 10. In the exemplary embodiment, a drain outlet 40 may be provided, for example, 10 feet average length from building 10. In alternate embodiments, the length may be more or less. Drainage system 20 has gutter 24 mounted below roof 22, downspout 26 connected to a subterranean drain pipe or conduit 28. By diverting the drainage water through drain pipe or conduit 28 away from building 10, basement or crawlspace 32 is maintained in a dryer condition. Here drain outlet 40 provides a termination of pipe 28, where pipe 28 may be any suitable pipe, for example, a sump discharge pipe (not shown) or downspout extension pipe in a yard or lawn. Drain outlet 40 may be used with a slight pitch on the lawn or otherwise where drain outlet 40 drains completely. The drainage water passes through subterranean pipe 28 below grade 36 of lawn or yard 34 and dispersed above grade 36 through drain outlet 40 coupled to pipe 28. Drain outlet 40 not need be but may be supported by gravel 38. Drain outlet 40 has front portion 42, rear portion 44 and inlet or receiver section 46 coupled to pipe 28. In the exemplary embodiment drain outlet 40, a low profile downspout drain outlet is provided to drain water to the grade 36 of lawn surface 34 or grade surface 36. Here, downspout drain outlet 40 may be coupled to downspout extension pipe 28 with pipe 28 being underground and below the grade of lawn surface 34 where low profile drain outlet 40 drains the water from subterranean pipe 28. As will be described in greater detail, downspout drain outlet 40 has a base having a drainage surface comprising a substantially flat bottom on gravel 38 and a drainage end 42 and a receiver section 46. The drainage surface directs the water away from pipe 28 and through the cover section to grade surface 34. The drainage surface of drain 40 is adapted to be positioned substantially below the grade surface 36 where the drainage surface may be positioned at a level or at a slight angle to substantially intersect the grade surface at drainage end 42. Receiver section 46 comprises a pipe inlet coupled to pipe 28. Here, the pipe inlet directs the water onto the substantially flat bottom with the drainage surface located below the pipe. As will be described in greater detail below, a cover section of drain 40 is coupled to the base, and inclined relative to the bottom or drainage surface of the base and intersecting the base at the drainage end 42. Here, the cover has drain holes for the water to pass there through. Here, the cover section is adapted to be positioned substantially uniform with and substantially in the same plane as the grade surface 34 or the grade of the lawn surface. This allows unobstructed use of the area of the yard that is occupied by the cover of drain 40. Drainage end 42 of drain 40 is adapted to drain substantially all of the water from pipe 28 to the grade 34 without leaving any residual water in the base and draining water through the cover section with drainage end 42 forming a front lip having openings for ease of flowing of water from the drainage surface. Additionally, the cover section forms a structural member capable of supporting an external load, for example, a garden tractor. Here, the cover of drain outlet 40 is flush with lawn 34 with the base placed into the lawn with pipe 28 below the lawn surface. Drain outlet 40 has a tapered shape to enable the flush exposed cover and to prevent accumulation of debris. Here, drain outlet 40 provides a composite & purposeful end to outlet pipe 28 where drain 40 provides an outlet and discharge routing, and further provides protection for the end of the pipe from damage from ground traffic and vice versa, for example, damage of ground traffic by a protruding and exposed pipe or termination.

Figure 2:
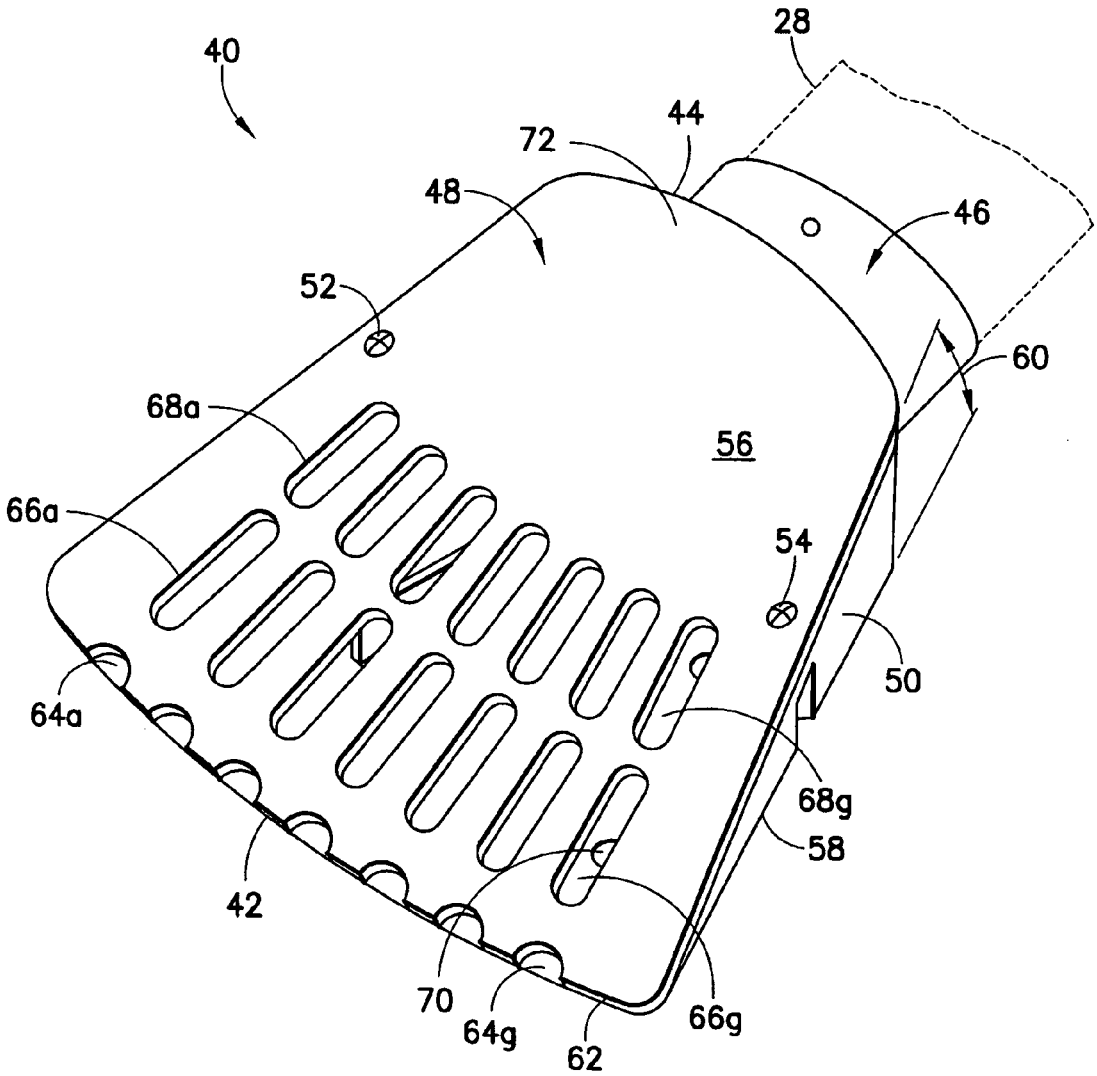
FIG. 2 is an isometric view of a drain outlet.

Referring now to FIG. 2, there is shown an isometric view of an exemplary embodiment drain outlet 40. Drain outlet 40 is provided to terminate pipe 28. Drain outlet 40 has front portion 42, rear portion 44 and inlet or receiver section 46. Receiver section 46 comprises a pipe inlet coupled the pipe 28. The pipe inlet directs the water from the pipe onto the substantially flat bottom with the drainage surface located below pipe 28. Receiver section 46 may be adapted to accept more than one pipe size. For example, receiver section 46 may be adapted to accept either 3" or 4" pipe where a 4" pipe may be squeezed smaller on the external surface of receiver 46 to save height and depth or a 3" pipe placed internal to receiver 46. Drain outlet 40 has cover or lid 48 and base 50. Fasteners 52, 54 are provided on top surface 56 for removal of cover 48 where cover 48 is removable. Cover 48 may be removable from base 50, for example, to facilitate cleaning. In alternate embodiments, cover 48 may be of unitary construction with base 50. In alternate embodiments, other suitable fasteners may be used, for example, a hinge and latch combination. Bottom surface 58 and top surface 56 form an inclined or tapered shape 60 terminating at front lip 62. Although the surfaces are shown as flat surfaces, any suitable shape may be provided. Here, drain outlet 40 is self flushing having a flat bottom and tapered top directing debris to be flushed out either flushed through holes or ready for removal by removal of cover 48. Here, the tapered top to bottom shape helps to prevent accumulation of debris. Here, cover section 48 is coupled to base 50, and may be removably coupled to base 50 with cover section 48 inclined relative to the bottom or drainage surface of base 50 and intersecting base 50 at drainage end 42. Cover 48 and the substantially flat bottom intersect forming a front lip 62. Openings 64*a*-64*g* are provided at front lip 62 to facilitate water drainage. Drainage end 42 drains substantially all of the water from pipe 28 to a grade without leaving any residual water in base 50 with base 50 positioned substantially below the grade and cover 48 positioned substantially uniform with and substantially in the same plane as the grade. Drainage holes or slots 66*a*-66*g* and drainage holes or slots 68*a*-68*g* are provided through the top surface 56 of cover 48 for drainage of water there through. In alternate embodiments, more or less holes or slots at different positions may be provided. Drain holes 70 are alternately provided in base 50 through the drainage surface in the event the lower portion 58 of base 50 is inclined toward rear portion 44. An inclined rear surface 72 relative to surface 56 is also provided. As will be described in greater detail, the drainage surface is internal to drain 40 and opposite of lower surface 58 and directs the water away from drain pipe 28 and through the cover section 48 to a grade surface. Although the drainage surface is shown as a flat surface, any suitable surface or shape may be provided. As shown, base 50 and cover section 48 form a wedge shaped perforated enclosure. The wedge shape plan acts as a diffuser to enable increased flow of water through drain 40. Cover 48 and base 50 may be made of formed structural polyethylene. In alternate embodiments, any suitable materials or fabrication techniques may be used.

Figure 3A:
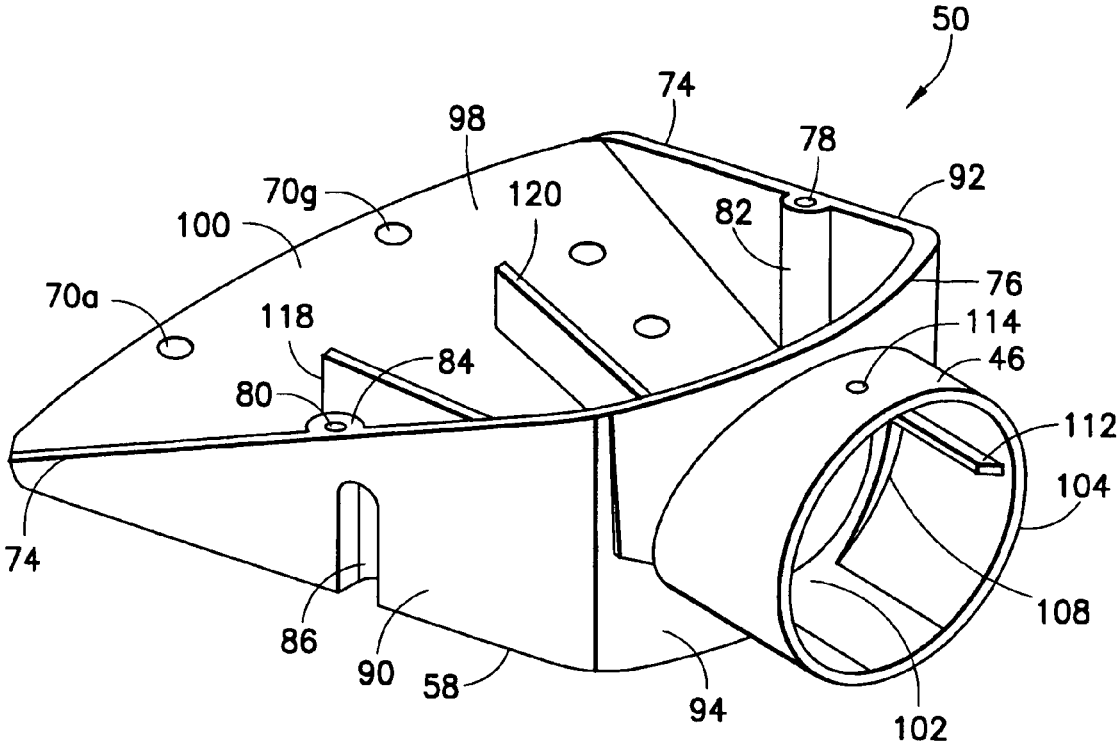
FIG. 3A is an isometric view of a base.
Figure 3B:
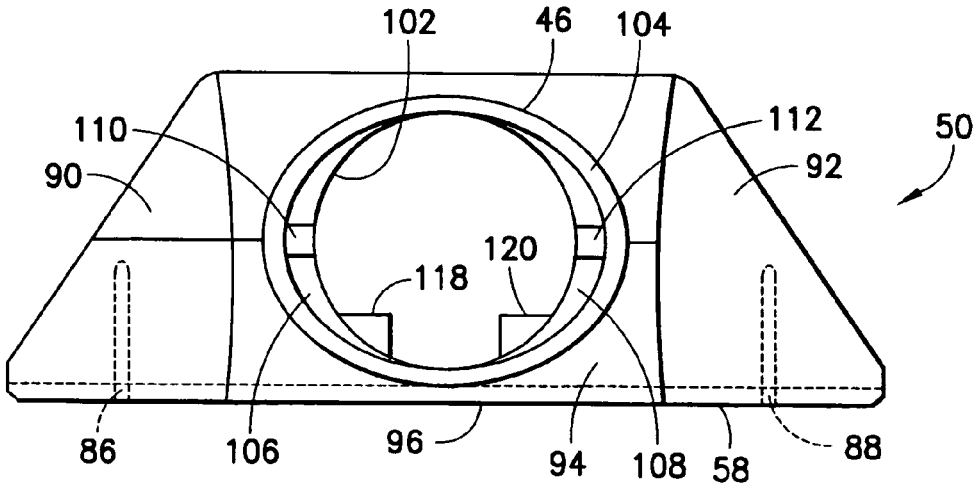
FIG. 3B is a back view of a base.
Figure 3C:
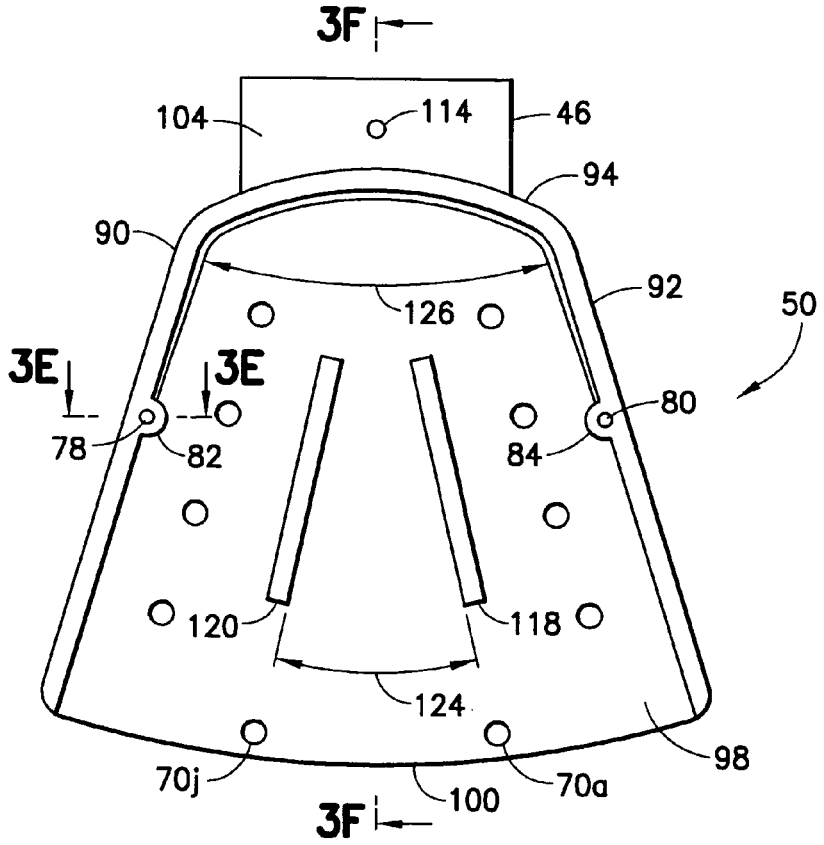
FIG. 3C is a top view of a base.
Figure 3E:
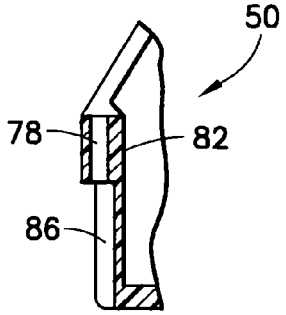
FIG. 3E is a section view of a base.
Figure 3D:
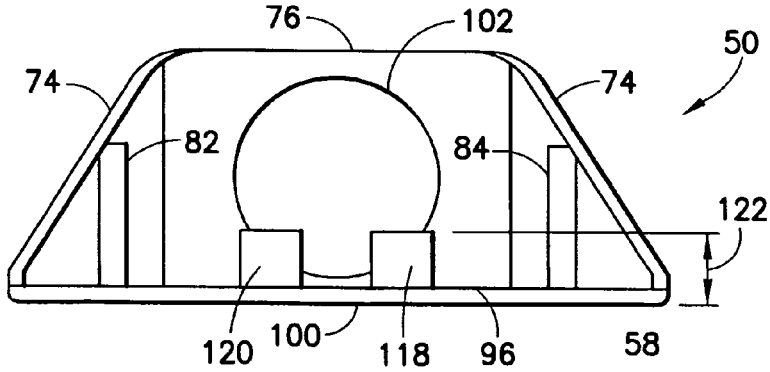
FIG. 3D is a front view of a base.
Figure 3G:
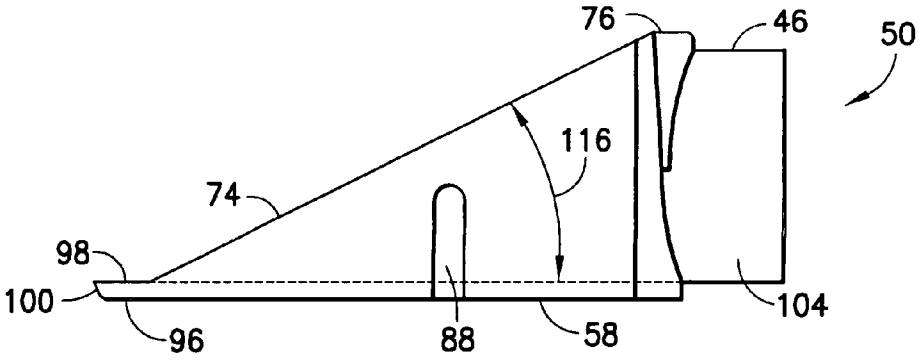
FIG. 3G is a side view of a base.
Figure 3H:
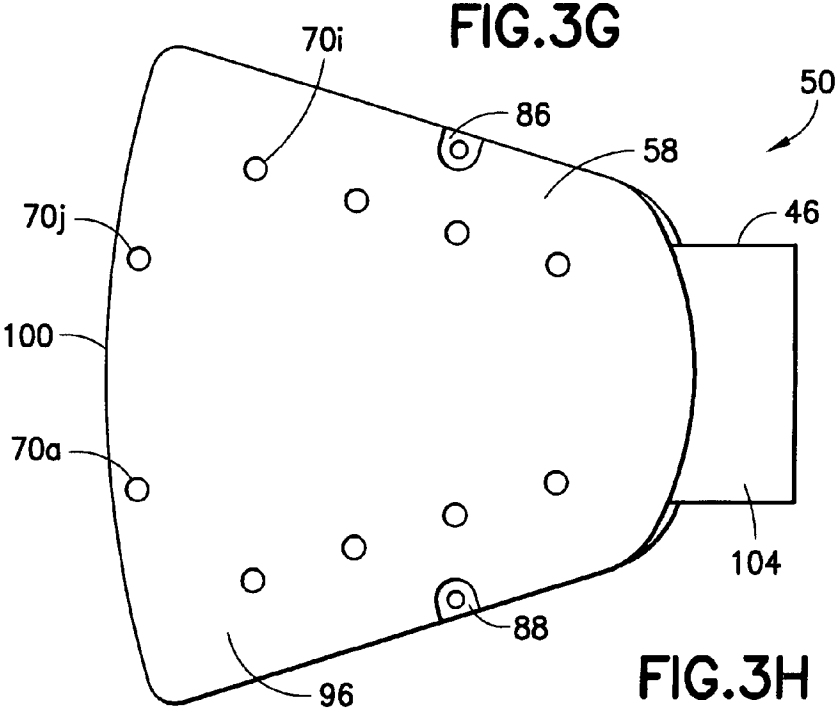
FIG. 3H is a bottom view of a base.
Figure 3F:
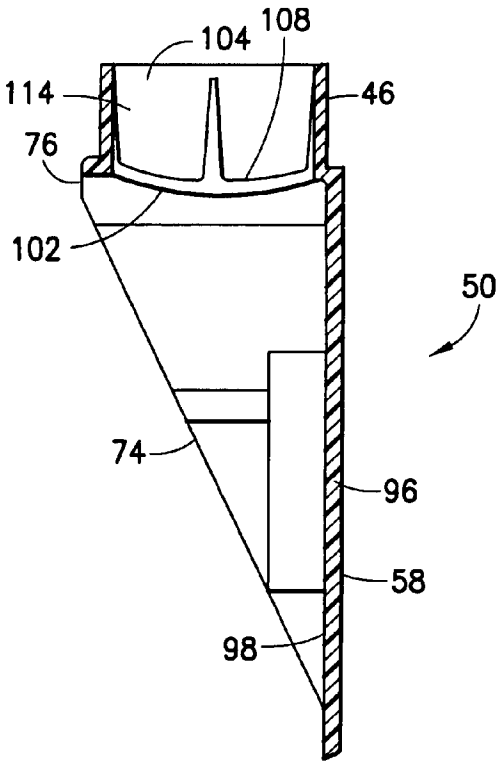
FIG. 3F is a section view of a base.

Referring now to FIG. 3A, there is shown an isometric view of base 50. Referring also to FIG. 3B, there is shown a back view of base 50. Referring also to FIG. 3C, there is shown a top view of base 50. Referring also to FIG. 3D, there is shown a front view of base 50. Referring also to FIG. 3E, there is shown a section view of base 50. Referring also to FIG. 3F, there is shown a section view of base 50. Referring also to FIG. 3G, there is shown a side view of base 50. Referring also to FIG. 3H, there is shown a bottom view of base 50. Base 50 is shown having inlet or receiver section 46. Base 50 has drainage surface 98 comprising a substantially flat bottom extending from drainage end 100 to receiver section 46. Here, drainage surface 98 directs the water away from the drain pipe and through cover section 48 to the grade surface. Although drainage surface 98 is shown as a flat surface, any suitable surface or shape may be provided. Base 50 has bottom surface 58 having drain holes 70*a*-70*j*. In the embodiment shown, holes 70*a* and 70*j* may alternately serve as pilot holes, for example to locate cover 48. In alternate embodiments, more or less holes may be provided. Mating surface 74 having rear mating surface portion 76 is provided to mate with and support cover 48. Taps 78, 80 and bosses 82, 84 are provided for fasteners 52, 54. Recesses 86, 88 are provided as relief in side walls 90, 92 for bosses 82, 84. Rear wall 94 and lower wall 96 are also provided to enclose base 50. Drainage surface 98 extends from front lip 100 to the rear wall 94 and is located below inlet bore 102 and inlet tube 104 to allow drainage of water from pipe 28. Inlet bore 102 is shown round for acceptance of a 3" Pipe. Inlet tube 104 is shown as an oval shape for acceptance of a 4" pipe on its outer surface. Shoulders 106, 108 and gussets 110, 112 are provided to seat the 3" pipe. In alternate embodiments, other suitable inlet or pipe sizes or shapes may be provided. Hole 114 is provided to support a fastener to fasten pipe 28 to receiver section 46. Angle 116 represents the taper angle of the drain 40. Diverters 118, 120 are shown coupled to drainage surface 98 and may be provided to divert and diffuse water flow. In the embodiment shown, diverters 118, 120 are shown with height 122. In alternate embodiments, other height may be provided, for example, where diverter 118, 120 extend to and mate with cover 48 providing further structural support. Diverters 118, 120 are shown separated by angle 124 less than angle 126 between sides 90, 92 to allow the water to diffuse. In alternate embodiments, more or less diverter(s) may be provided.

Figure 4A:
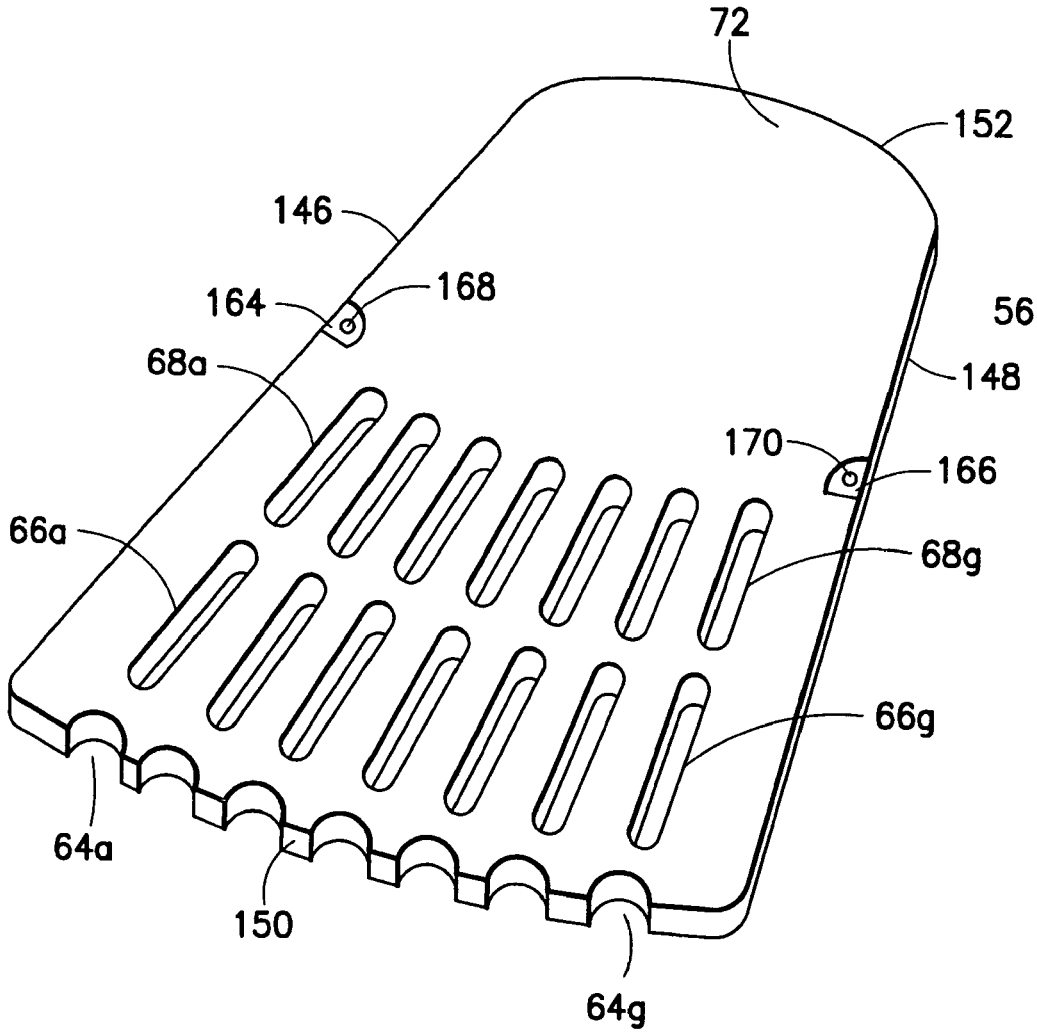
FIG. 4A is an isometric view of a cover.
Figure 4B:
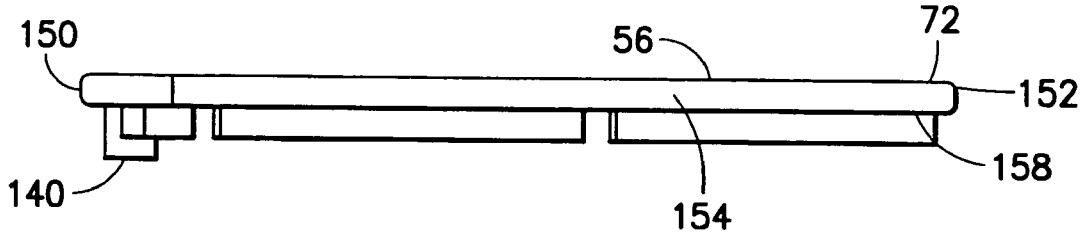
FIG. 4B is a side view of a cover.
Figure 4D:
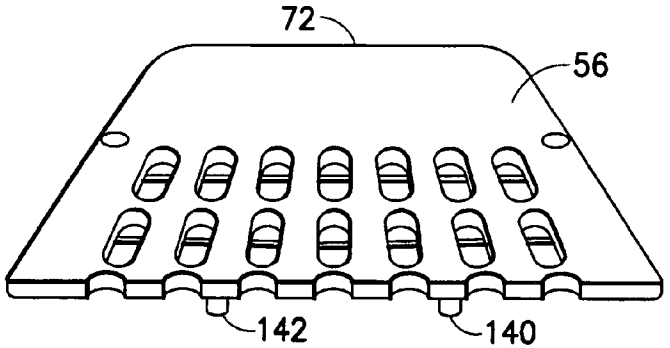
FIG. 4D is a front view of a cover.
Figure 4E:
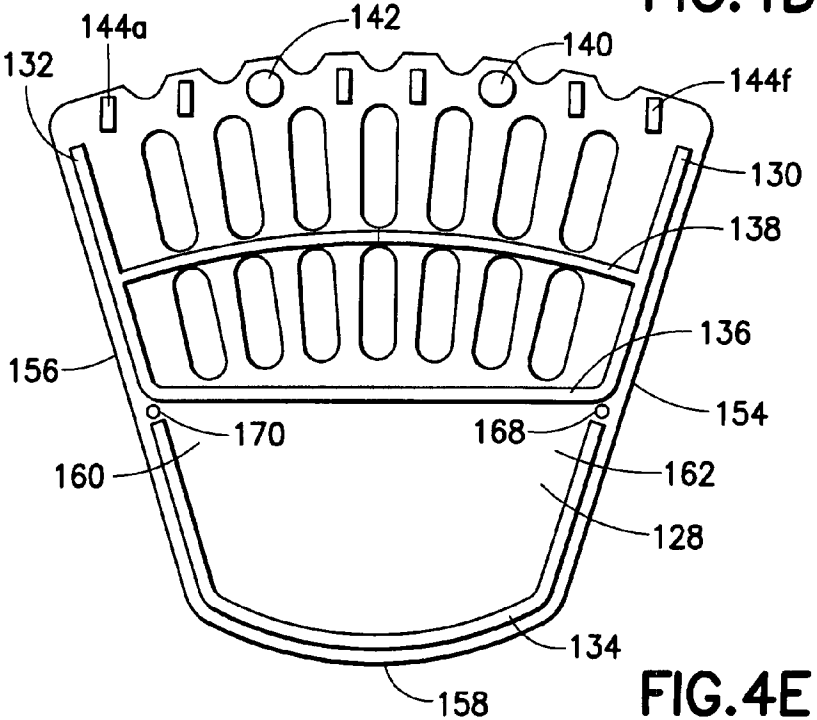
FIG. 4E is a bottom view of a cover.
Figure 4C:
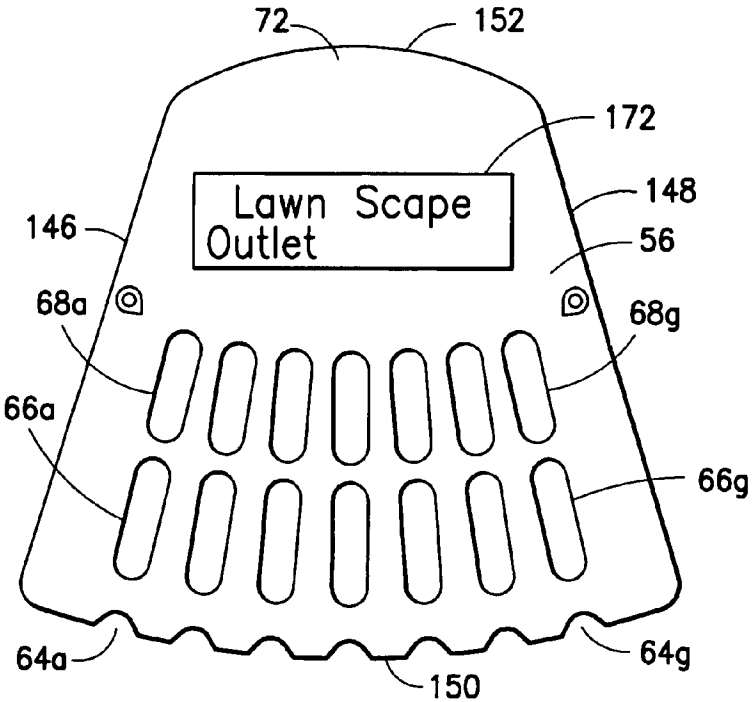
FIG. 4C is a top view of a cover.

Referring now to FIG. 4A, there is shown an isometric view of cover 48. Referring also to FIG. 4B, there is shown a side view of cover 48. Referring also to FIG. 4C, there is shown a top view of cover 48. Referring also to FIG. 4D, there is shown a front view of cover 48. Referring also to FIG. 4E, there is shown a bottom view of cover 48. Cover or lid 48 has top surface 56 having openings 64*a*-64*g* providing drainage at front lip 42 of drain 40. Openings 64*a*-64*g* allow drainage where cover 48 and substantially flat bottom 98 intersect at the front lip with water draining through openings 64*a*-64*g*. Drainage holes or slots 66*a*-66*g* and Drainage holes or slots 68*a*-68*g* are also provided to allow water to pass through top surface 56 of cover 48. In alternate embodiments, more or less holes, slots or openings at different locations may be provided in the cover 48 or drain 40. Inclined rear surface 72 is provided. Bottom surface 128 of cover 48 is provided having structural ribs 130, 132, 134, 136, 138 providing structural support and allowing external loads, for example from lawn equipment or occupants. In alternate embodiments, more or less ribs or structural members may be provided. The bottom ribs further seat cover 48 relative to the walls of base 50 for added support. Here, the cover section forms a structural member capable of supporting an external load. Tapered pins 140, 142 are provided to interface and locate cover 48 with locating holes 70, 70*j* of base 50. Support wedges 144*a*-144*f* are provided to interface with drainage surface 98 of base 50 preventing deflection or collapse of cover 48 or openings 64*a*-64*g*. Side portion 146, 148, front lip 150 and rear portion 152 are provided as interface to front portion 100, side portions 90, 92 and rear portion 94 of base 50. Side mating surfaces 154, 156, rear mating surface 158 and boss support 160, 162 are provided to interface with supporting surfaces 74, 76, 78, 80 of base 50. Counter bore 164, 166 are provided with bore 168, 170 for fasteners 52, 54. Logo 172 may also be provided.

It should be understood that the foregoing description is only illustrative of the invention. Various alternatives and modifications can be devised by those skilled in the art without departing from the invention. Accordingly, the present invention is intended to embrace this and all such alternatives, modifications and variances which fall within the scope of the appended claims.

What is claimed is:

1. A building drain system for draining water from a building to a ground surface, the system comprising:

a building drain extension pipe capable of being disposed underground and below a grade of the ground surface, and a drain outlet communicably coupled to the pipe, the drain outlet comprising:

a base having a drainage surface terminating at a drainage end, forming at least one effluent drainage hole, and an inlet section, the inlet section adapted to be coupled to an outlet of the extension pipe, the drainage surface being substantially flat between the inlet section and the at least one effluent drainage hole at the drainage end, the drainage surface disposed for guiding effluent from inlet section to drainage end; and a cover section coupled to and covering the base, wherein, the base is configured for founding the drain outlet to the ground, when the drain outlet is coupled to the extension pipe disposed underground, so that the at least one drainage hole is located substantially at or above the grade allowing substantially unimpeded effluent discharge from inlet section through the at least one drainage hole to the ground surface.

2. The system of claim 1, wherein the cover section has other drainage holes for effluent drainage.

3. The system of claim 1, wherein the cover section is inclined relative to the drainage surface of the base, intersects the base at the drainage end, and is removably coupled to the base.

4. The system of claim 1, wherein the base and the cover section form a wedge shaped perforated enclosure.

5. The system of claim 1, wherein the drainage surface includes other drainage holes.

6. The system of claim 1, wherein the cover section further comprises stiffening ribs, and wherein the cover section forms a structural member capable of supporting an external load.

7. The system of claim 1, wherein the base further comprises a diverter coupled to the drainage surface, the diverter adapted to divert the water.

8. The system of claim 1, wherein the base is arranged to be positioned with at least a portion substantially below the grade of the ground surface, and wherein, the cover section is arranged to be positioned substantially uniform with the grade of the ground surface, and wherein, the drainage end is adapted to drain substantially all of the effluent from the pipe to the grade of the ground surface.

9. The system of claim 1, wherein the extension pipe is coupled to and fed by at least one of a downspout or a basement or crawlspace sump.

10. A low profile building drain surface outlet for draining effluent from a subterranean building drain pipe to a grade, the low profile drain outlet comprising;

a base; and a cover coupled to the base;

the base having a substantially flat bottom, the base having a pipe inlet capable of being coupled to the building drain pipe, the pipe inlet directing the effluent onto the substantially flat bottom;

the cover having a substantially flat portion inclined relative to the bottom of the base, the cover having one or more surface drain holes for the effluent to pass there through onto the grade;

the substantially flat portion of the cover being substantially coplanar with the grade and having an edge disposed adjacent to the substantially flat bottom forming a discharge edge of the drain outlet having at least one of the surface drain holes.

11. The outlet of claim 10 wherein, the base is positioned substantially below the grade of a lawn, and wherein, the cover is positioned substantially at the surface of the grade.

12. The outlet of claim 10, wherein the cover is removably coupled to the base.

13. The outlet of claim 10, wherein the base and the cover form a wedge shaped perforated enclosure.

14. The outlet of claim 10, wherein the substantially flat bottom further comprises drainage holes.

15. The outlet of claim 10, wherein the cover further comprises stiffening ribs, and wherein the cover forms a structural member capable of supporting an external load.

16. The outlet of claim 10, wherein the base further comprises a diverter coupled to the substantially flat bottom, the diverter adapted to divert the water.

17. A building drain to surface outlet adapted to drain water from a building to a grade surface, the building drain outlet coupled to a building drain pipe, the pipe being underground and below the grade surface, the building drain outlet comprising:

a base having a drainage surface;

a cover section removably coupled to the base and having a substantially flat portion inclined relative to the drainage surface of the base; and the base having an inlet coupled to the building drain pipe with the drainage surface located below the pipe, the drainage surface adapted to direct the water away from the drain pipe and through the flat portion of the cover section to the grade surface;

wherein, the drainage surface is adapted to be positioned substantially below the grade surface, and wherein, the drainage surface is adapted to be positioned to substantially intersect the grade surface, and wherein, the flat portion of the cover section is adapted to be positioned substantially uniform and coplanar with the grade surface, and wherein, the drainage surface is adapted to drain substantially all of the water from the pipe to the grade surface without leaving any residual water in the base.

18. The drain outlet of claim 17, wherein water drains through drainage holes in the cover section.

19. The drain outlet of claim 17, wherein the base and the cover section form a wedge shaped perforated enclosure.

20. The drain outlet of claim 17, wherein the cover section further comprises stiffening ribs, and wherein the cover section forms a structural member capable of supporting an external load.

* * * * *